US008615842B2

(12) United States Patent
Treacy

(10) Patent No.: US 8,615,842 B2
(45) Date of Patent: Dec. 31, 2013

(54) MOP BUCKET AND WRINGER SYSTEM WITH ABILITY TO REDUCE LIQUID MOVEMENT

(76) Inventor: Terry Treacy, Mansfield, TX (US)

( * ) Notice: Subject to any disclaimer, the term of this patent is extended or adjusted under 35 U.S.C. 154(b) by 0 days.

(21) Appl. No.: 13/279,264

(22) Filed: Oct. 22, 2011

(65) Prior Publication Data

US 2012/0096669 A1 Apr. 26, 2012

Related U.S. Application Data

(60) Provisional application No. 61/406,023, filed on Oct. 22, 2010.

(51) Int. Cl.
*A47L 13/58* (2006.01)

(52) U.S. Cl.
USPC ..... 15/260; 15/261

(58) Field of Classification Search
USPC ..... 15/260, 261
See application file for complete search history.

(56) References Cited

U.S. PATENT DOCUMENTS

| | | | | |
|---|---|---|---|---|
| 2,860,809 | A * | 11/1958 | Perry | 220/563 |
| 7,216,397 | B1 * | 5/2007 | Tanner | 15/320 |
| 7,571,831 | B2 * | 8/2009 | Lauer et al. | 220/555 |
| 2002/0120997 | A1 * | 9/2002 | Alt | 15/261 |
| 2005/0086760 | A1 * | 4/2005 | Young | 15/260 |

* cited by examiner

*Primary Examiner* — Shay Karls
(74) *Attorney, Agent, or Firm* — Wilson Daniel Swayze, Jr.

(57) ABSTRACT

A mop bucket system may include a mop bucket to contain fluids, a wringer unit including a wringer cone connected to the mop bucket to remove the fluid from a mop, and a pivotable energy-dissipation device connected to the wringer unit to dissipate energy of the fluid in the wringer unit. The energy dissipation device may pivot between a first position and a second position, and the energy dissipation device may include a aperture. The energy dissipation device may include a notch, and the energy dissipation device may include a sleeve bushing. The energy dissipation device may include a side surface having a curved portion.

5 Claims, 6 Drawing Sheets

MOP BUCKET AND WRINGER SYSTEM WITH ABILITY TO REDUCE LIQUID MOVEMENT

PRIORITY

The present invention claims priority based upon 35 USC section 119 and the provisional application with a Ser. No. 61/406,023 which was filed on Oct. 22, 2010.

FIELD OF THE INVENTION

The present invention relates to a mop bucket system and more particularly to a mop bucket system which includes with ability to reduce liquid movement.

BACKGROUND

Mop bucket systems are commonly used for cleaning purposes. A mop bucket contains liquid used for cleaning. It is typically used to facilitate the mopping of floors.

The use of a mop to clean floors is an age-old method still practiced extensively because it is effective. A typical mop has an elongated handle with a mop head attached to one end. The mop head is formed of strands of moisture adsorbent material, which can be natural or man-made. A mop is generally used with a bucket of water to both wet and rinse the mop head after use. The normal method of using a mop is to wet the mop head in the bucket of water, wring out the mop head by hand and then push the mop head over the floor surface to remove dirt or pick up excess moisture. Once the mop head has been pushed over a certain area of floor, the mop head is placed in the bucket of water to rinse out the dirt and soil removed from the floor. The mop head is then wrung out to remove excess moisture and the process is repeated until the water in the bucket becomes too dirty and must be changed. However, there are certain disadvantages inherent in a simple mop and bucket. Among these are difficulties in wringing and cleaning the mop by hand to remove liquid and dirt so that the mop is as clean as possible when used on the floor. Another problem is what to do with the mop while the water in the bucket is being changed. It is not advisable to simply lay the mop on the floor. Dumping a large bucket of water can also be a problem simply because of the weight.

While the mop and bucket system as described above only discusses the use of water in the bucket, it is well known that warm or hot water will clean better than simple cold water. Likewise, it is common to add chemical solutions to assist in cleaning or whatever the desired effect might be. For example, wax stripper might be needed to clean wax build up, or a disinfectant might be needed in a health care facility. Such chemical solutions would usually be provided in individual containers and manually mixed in the bucket.

Mop bucket systems are commonly used for cleaning purposes. A mop bucket contains liquid used for cleaning. It is typically used to facilitate the mopping of floors.

With a conventional mop bucket, cleaning liquid may spill or splash during use. For example, often the mop bucket and cleaning liquid must be moved from one location to another. During this movement, the mop bucket will be subjected to differing Newtonian forces. The mop bucket will experience a starting force as it is initially accelerated toward the next location and will experience a stopping force when it reaches that location and is decelerated. Also, while the bucket is being moved, it may experience instantaneous turbulent forces at the interface between the liquid and air, sometimes called wave amplification or ripples. The changing forces on the mop bucket will cause the cleaning liquid to be displaced relative to the mop bucket. The displacement of the cleaning liquid can result in the formation of a wave that splashes over the top of a wall of the mop bucket and out onto a floor or stairway. Also, the amplification of these waves due to the high degree of turbulence may also cause splashing and liquid droplets to exit the mop bucket. Spillage of the cleaning liquid is problematic. For example, cleaning liquid that has spilled out of the mop bucket onto a floor or stairway create a slip-and-fall hazard if not immediately removed. Even if the liquid is immediately removed, non-productive man hours are required to clean the spill. Spillage also is inefficient and undesirable because it can result in the loss of cleaning liquid.

It would be desirable to have a mop bucket system that reduces the spillage of cleaning liquid.

SUMMARY

A mop bucket system may include a mop bucket to contain fluids, a wringer unit including a wringer cone connected to the mop bucket to remove the fluid from a mop, and a pivotable energy-dissipation device connected to the wringer unit to dissipate energy of the fluid in the wringer unit.

The energy dissipation device may pivot between a first position and a second position, and the energy dissipation device may include a aperture.

The energy dissipation device may include a notch, and the energy dissipation device may include a sleeve bushing.

The energy dissipation device may include a side surface having a curved portion.

BRIEF DESCRIPTION OF THE DRAWINGS

The invention may be understood by reference to the following description taken in conjunction with the accompanying drawings, in which, like reference numerals identify like elements, and in which:

FIG. 1 illustrates a side view of the mop bucket with the flexible panel; a

DETAILED DESCRIPTION

Figure 1:
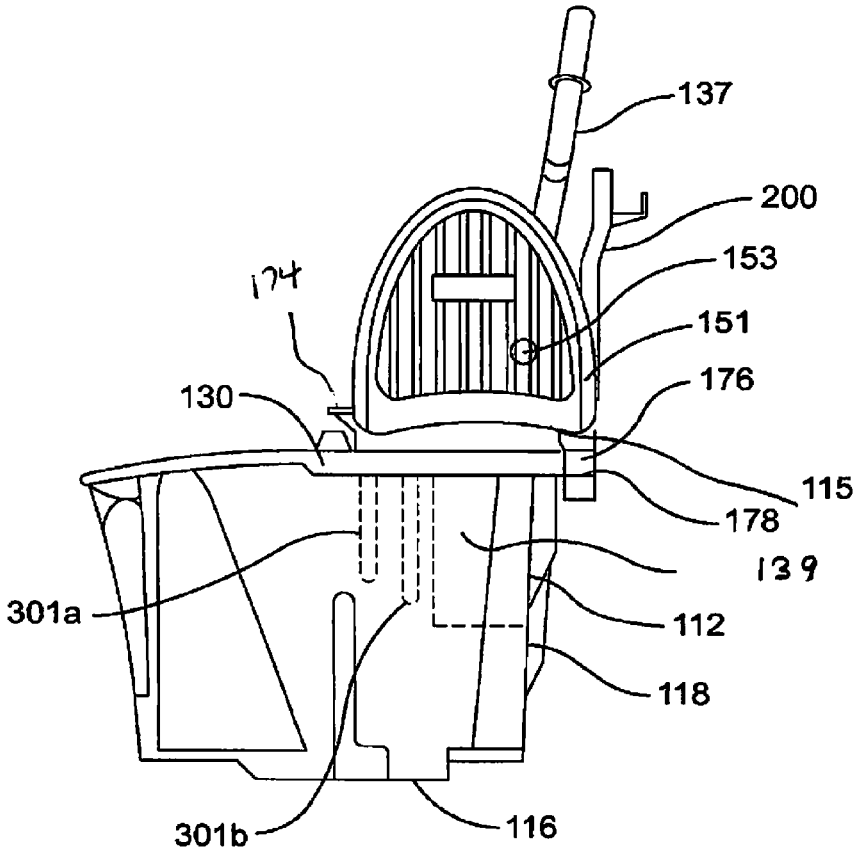

Mop buckets and wringers are a common and ubiquitous cleaning product that is used in many public environments such as restaurants, hotel lobbies, food stores, and airports. They are commonly used in combination with mops and a cleaning solution. In virtually all applications, a solution is contained inside the bucket and a mop is used to spread solution. An aspect of the present invention relates to a mop bucket system including a liquid-retaining portion and an energy-dissipation device. The liquid-retaining portion is configured to retain liquid. It has a bottom wall portion, a first sidewall portion, a second sidewall portion facing the first sidewall portion, a third sidewall portion, and a fourth sidewall portion facing the third sidewall portion.

Extending downward from the mop wringer assembly is a fluid restricting flexible panel with apertures which may extend through the panel which may perforations which will reduce the momentum of liquid as it may move between the first and second sidewall portions. The panel may be rigid in other embodiments. The apertures of the fluid restricting flexible panel allow liquid to pass under steady state conditions, however will reduce the rapid movement of liquid within the peripheral wall reducing the tendency of the liquid to splash out of the mop bucket and onto the floor. The panel which may be referred to as a energy-dissipation device is configured to inhibit build up of momentum of liquid within the mop bucket, generally defined by the peripheral wall.

The panel may be able to pivot in a front to back direction which enables a mop to move freely within the liquid retaining portion; alternatively the panel may be able to pivot by rotating within the mop bucket.

A mop bucket and a wringer unit 110 is disclosed in which the bucket 112 has a bottom surface 116, and a peripheral wall 118 which extends upwards from the bottom surface 116 and around the periphery of the bottom surface 116. The wringer unit 110 may be supportable on an upper edge 130 of the peripheral wall 118 of the mop bucket 112, and being releasably engagable from the bucket 112. There being releasable engaging device including a pivotable clip 174 on each of two opposing sides of the combination mop bucket and wringer unit 110 and an engagable element 176 with which a respective pivotable clip 174 can be snap-fit releasably engaged. Each pivotable clip 174 may be formed independently of the mop bucket 112. Alternatively, the wringer unit 110 may be rigidly attached to the mop bucket 112.

The wringer unit 110 may include a wringer cone 115 to cooperate with the bucket wall interior surface the top end of the peripheral wall 118. The bucket 9 and wringer cone 115 are preferably constructed of plastic or polymer sheet material and it would be advantageous to produce them as one piece using injection-molding technology.

The wringer cone 115 may be a downward facing or inverted circumferential cone having a wringer cone wall 117 with a plurality of wringing slots 119 and a wringer cone bottom hole 131. The wringer cone 115 includes wringing slots 119, spaced at a distance apart toward the wringer cone bottom hole 131. The movable press elements 133 are elongate pieces or bars which extend across the channel 135 and which, in use, then urge and squeeze the absorbent mop material into the channel 135 as they move into the channel 135.

The handle 137 may be pivotably mounted over the opening 139 of the wringer unit 110, so as substantially to centralize the force imparted by the user and thus reduce undesirable twisting moments being imparted to the unit.

Opposite side walls 151 of the wringer unit 110 project upwardly from the channel 135, and the wringer unit 110 includes side covers 153 which cover the geared press mechanism. The mop bucket 112 may include pivotable wheels 155 in order to facilitate movement of the mop bucket and wringer unit 110.

FIG. 1 illustrates a substantially rotated C-shaped sign device 200 which may be detachably connected to the mop bucket and wringer unit 110 in order to allow the user to guide the wringer unit 110.

FIG. 1 illustrates that the effects mop bucket and wringer unit 110 may include a fluid restricting flexible panel 301 which may extend downward from the mop bucket and wringer unit 110 into the mop bucket 112 with apertures 303 which may extend through the panel 301 which may reduce the momentum of liquid as it may move between the peripheral wall 118. FIG. 1 illustrates the panel 301*a* in a first position as a result of steady-state (no or little motion of fluid within the bucket) and illustrates the panel 301*b* in a second position as a result of a disturbance of the bucket (motion within a fluid within the bucket). The panel 301 may be rigid in other embodiments. The apertures 303 of the fluid restricting flexible panel 301 allow liquid to pass under steady state conditions, however will reduce the rapid movement of liquid within the peripheral wall 118 reducing the tendency of the liquid to splash out of the mop bucket 112 and onto the floor. The panel 301 which may be referred to as a energy-dissipation device is configured to inhibit build up of momentum of liquid within the mop bucket, generally defined by the peripheral wall 118.

The panel 301 may be able to pivot in a front to back direction which enables a mop to move freely within the liquid retaining portion; alternatively the panel 501 may be able to pivot by rotating within the mop bucket.

Figure 2:
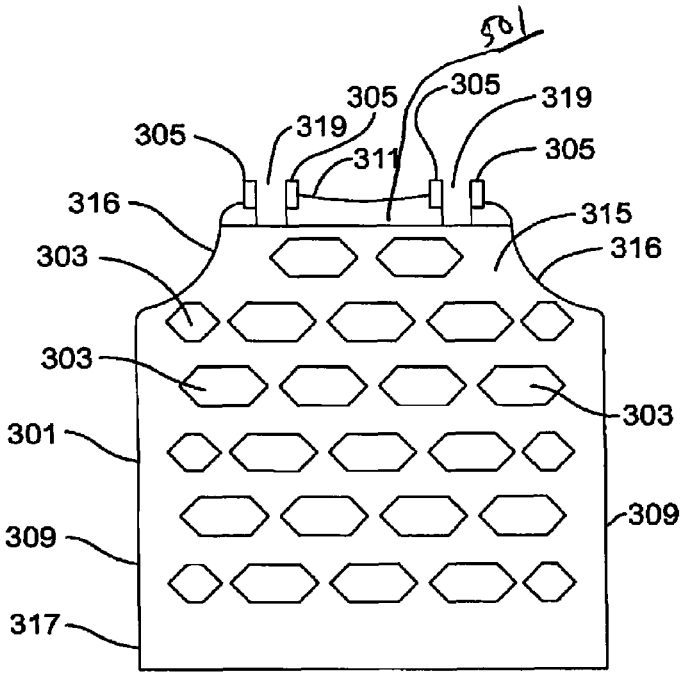
FIG. 2 illustrates a front view of the flexible panel of the present invention.

FIG. 2 illustrates a front view of the flexible panel 301 and shows a front surface 315 which may be connected to a pair of opposing side surfaces 309 and which may be connected to a bottom surface 313. The opposing side surfaces 309 may be connected to the bottom surface 313 and the mirrored back surface 317, and the bottom surface 313 may be connected to the back surface 317. Each of the opposing side surfaces 309 may include a concave curved portion 316 which may connect to a top surface 311 which may be connected to the front surface 315 and an opposing back surface 317. The top surface may include a notch 319 which may be defined by a first and second sleeve bushing 305. The front surface 315 may further define a multitude of apertures 303 which may be all-time sided, circular, oval or other appropriate shape and which may be randomly position or positioned in accordance with a pattern. The aperture 303 may extend through the flexible panel 301.

The sleeve bushing 305 may cooperate with a shaft positioned within the wringer cone 115.

Figure 3:
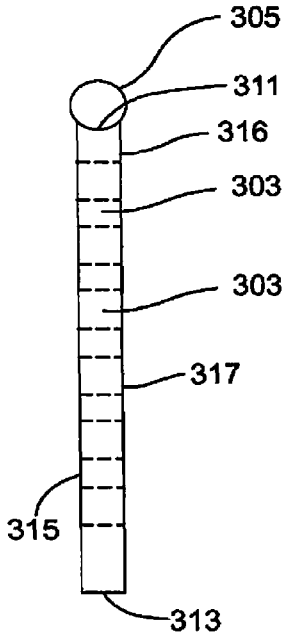
FIG. 3 illustrates a side view of the flexible panel of the present invention.

FIG. 3 illustrates a side view of the flexible panel 301 and illustrates the sleeve bushing 305, the front surface 315, the back surface 317, the top surface 311 the side surface 309 and the curved portion 316 of the side surface 309.

Figure 4:
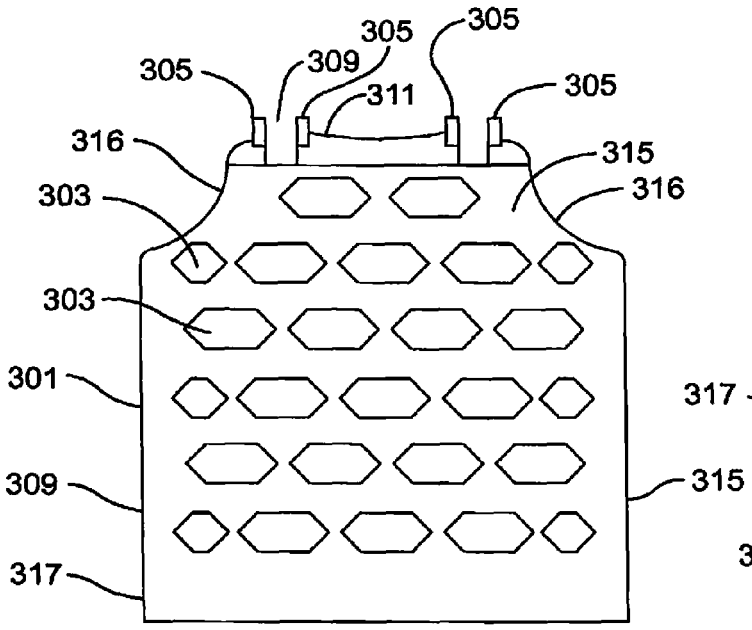
FIG. 4 illustrates a back view of the flexible panel of the present invention.

FIG. 4 illustrates a back view of the flexible panel 301 and shows a front surface 315 which may be connected to a pair of opposing side surfaces 309 and which may be connected to a bottom surface 313. The opposing side surfaces 309 may be connected to the bottom surface 313 and the mirrored back surface 317, and the bottom surface 313 may be connected to the back surface 317. Each of the opposing side surfaces 309 may include a concave curved portion 319 which may connect to a top surface 311 which may be connected to the front surface 315 and an opposing back surface 317. The top surface may include a notch 319 which may be defined by a first and second sleeve bushing 305. The front surface 315 may further define a multitude of apertures 303 which may be all-time sided, circular, oval or other appropriate shape and which may be randomly position or positioned in accordance with a pattern. The aperture 303 may extend through the flexible panel 301.

The sleeve bushing 305 may cooperate with a shaft positioned within the wringer cone 115.

Figure 5:
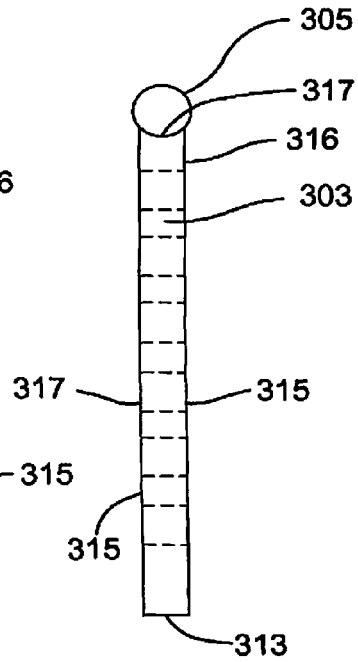
FIG. 5 illustrates a side view of the flexible panel of the present invention.

FIG. 5 illustrates an opposing side view of the flexible panel 301 and illustrates the sleeve bushing 305, the front surface 315, the back surface 317, the top surface 311 the side surface 309 and the curved portion 316 of the side surface 309.

Figure 6:
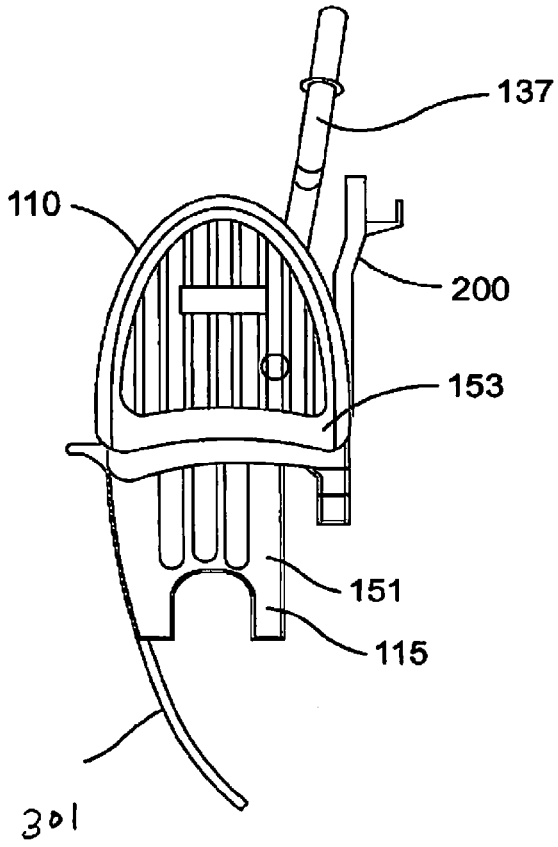
FIG. 6 illustrates a side view of the wringer unit and flexible panel of the present invention.
Figure 7:
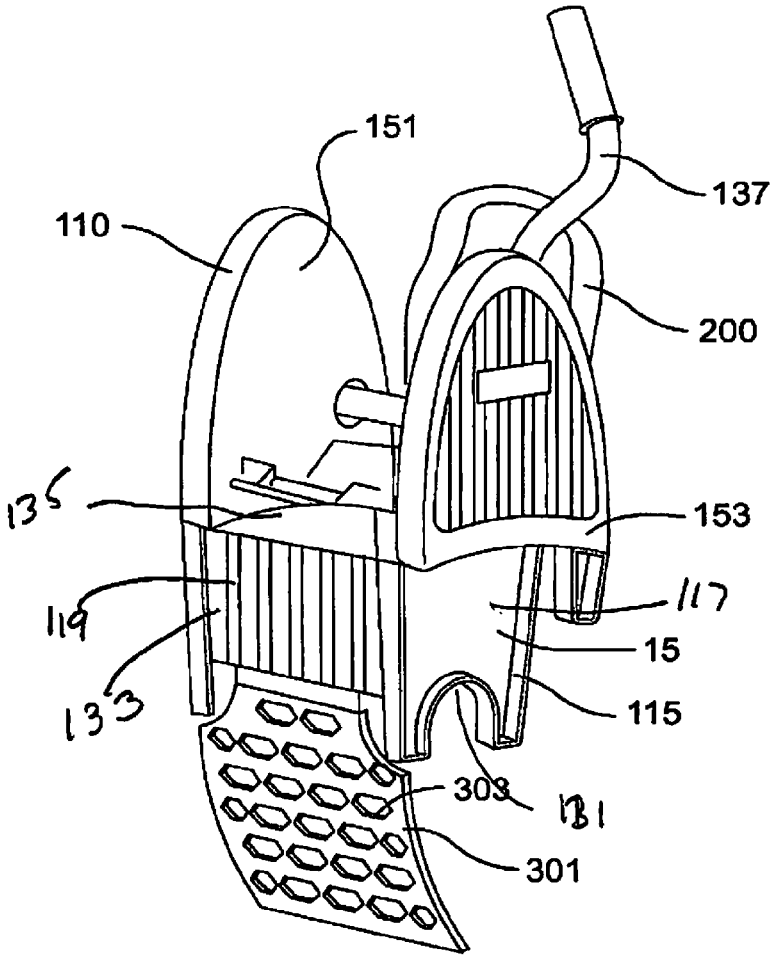
FIG. 7 illustrates a perspective view wringer unit and flexible panel of the present invention.

FIG. 6 illustrates the flexible panel 301 which may be mounted on the wringer unit 110 and FIG. 6 illustrates the sign device 200, the wringer cone 115, the side walls 151 and the cover 153. FIG. 7 additionally illustrates the handle 137.

FIG. 7 illustrates a perspective view of the flexible panel 301 which may include the apertures 303 and which may be mounted on the wringer unit 110, and FIG. 7 illustrates the sign device 200, the wringer cone 115, the side walls 151 and the cover 153. FIG. 6 additionally illustrates the handle 137.

Figure 8:
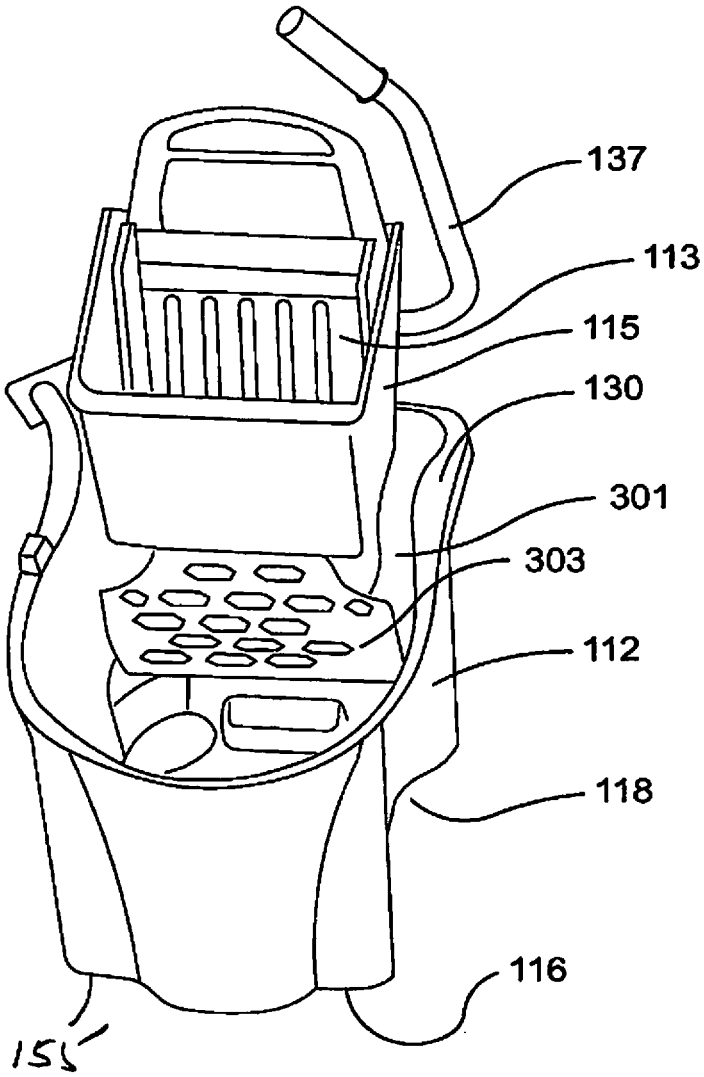
FIG. 8 illustrates a perspective view of the mop bucket and flexible panel of the present invention.

FIG. 8 illustrates a perspective view of the mop bucket 112 and the wringer cone 115 which may include the flexible panel 301 which may include the apertures 303 and which may be mounted on the wringer unit 110, and FIG. 7 illustrates the sign device 200, the wringer cone 115, the side walls 151 and the cover 153. FIG. 8 additionally illustrates the handle 137.

FIG. 8 additionally illustrates the movable press elements 113, the peripheral wall 118 and the edge 130.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. A mop bucket system, comprising:

a mop bucket to contain fluids;

a wringer unit including a wringer cone connected to the mop bucket to remove the fluid from a mop;

an energy-dissipation device connected to the wringer unit to dissipate energy of the fluid in the wringer unit, wherein the energy-dissipation device is connected to the wringer unit and wherein the energy-dissipation device pivots between a first position and a second position.

2. A mop bucket system as in claim 1, wherein the energy-dissipation device includes a aperture.

3. A mop bucket system as in claim 1 wherein the energy-dissipation device includes a notch.

4. A mop bucket system as in claim 3, wherein the energy-dissipation device includes a sleeve bushing.

5. A mop bucket system as in claim 4, wherein the energy-dissipation device a side surface having a curved portion.

* * * * *